United States Patent [19]

Boeniger

[11] Patent Number: 4,700,855

[45] Date of Patent: Oct. 20, 1987

[54] AUTOMATIC COUPLING FOR MODEL RAIL VEHICLES

[75] Inventor: Hanspeter Boeniger, Widen, Switzerland

[73] Assignee: Georg Utz AG, Bremgarten, Switzerland

[21] Appl. No.: 696,419

[22] Filed: Jan. 30, 1985

[30] Foreign Application Priority Data

Jan. 31, 1984 [CH] Switzerland ..... 526/84

[51] Int. Cl.[4] ..... B16G 1/06; B16G 1/36

[52] U.S. Cl. ..... 213/75 TC; 213/88; 213/211

[58] Field of Search ..... 213/75 TC, 88, 93, 211; 104/DIG.1; 105/1 T, 157 T, 238 T, 1.5, 157.2, 238.2

[56] References Cited

U.S. PATENT DOCUMENTS

| | | | |
|---|---|---|---|
| 1,897,362 | 2/1933 | Daniels | 213/75 TC |
| 2,261,258 | 11/1941 | Kinnear | 213/75 TC |
| 3,608,237 | 9/1971 | Richter | 213/75 TC |

FOREIGN PATENT DOCUMENTS

| | | | |
|---|---|---|---|
| 893624 | 10/1953 | Fed. Rep. of Germany | 213/75 TC |
| 964442 | 8/1950 | France | 213/75 TC |
| 981462 | 5/1951 | France | 213/75 TC |
| 365701 | 1/1932 | United Kingdom | 213/75 TC |

*Primary Examiner*—Randolph A. Reese

*Attorney, Agent, or Firm*—Edmund M. Jaskiewicz

[57] ABSTRACT

A coupler for rail vehicles of a model railway is attached to the end of a vehicle along substantially the longitudinal central axis of the vehicle. The coupler is provided with a coupling carrier which has at its free end a coupling plate acting as a buffer. In the coupled condition of railway vehicles, these coupling plates abut against each other and coupling hooks are positioned behind the coupling plates to retain the vehicles in coupled relationship.

10 Claims, 4 Drawing Figures

AUTOMATIC COUPLING FOR MODEL RAIL VEHICLES

The present invention relates to automatic couplers for model rail vehicles, more particularly, to such a coupler mounted on the end of a rail vehicle and having at least one buffer and disposed substantially along the longitudinal axis of the vehicle.

The use of automatic couplers in model railroading enabled trains of one or more locomotives and a number of cars to be easily assembled without human assistance. Prior to the era of the HO gauge, model railroads, the cars and locomotives manufactured by Marklin had to be laboriously coupled together by hand. The couplings themselves function satisfactorily and the size of the equipment used in O gauge, the smallest size gauge in use at that time, having a 32 mm. track guage made possible manual coupling and uncoupling operations without any hesitation.

With the development and increased use of the HO guage model railways, or 16 mm. track width (scale 1: 87) which is the most common in use today, an automatic coupling of the vehicles was needed since the relative small size of this scale made difficult or even prevented manual manipulation of connections between vehicles and in particular, coupling and uncoupling the vehicles. There thus resulted the known run-on or contact couplings which, in a modified form, are still used today. However, these couplings have a spacing which is dependent upon the track and are only able to function when precisely adjusted. Originally, the couplings were held in the direction of travel by a draw spring on its inner end and today, elements including leaf springs fix the positions of the couplings so that they do not deviate from the direction of travel. These characteristics of the couplings make very difficult the operation of coupling cars on a curved track.

The larger I gauge having a 45 mm. track width (scale 1:32) which has become popular in recent years and because of its size can also be used outdoors employs still another form of automatic couplers. For example, the LGB has an automatic or running together coupling which is connected on the bogie of the running axles. For this purpose, a bracket extends outwardly from the bogie toward the end of the vehicle and the coupling device is mounted on the free end of the bracket. The coupling device consists of a coupling carrier which projects outwardly beyond the frame of the vehicle and a protruding trap frame for the coupling hooks of the other vehicle which is to be coupled. There is a vertical rotary pin protruding on the underside of the coupling carrier and the coupling hook is positioned loosely on the pin so that the hook can execute a pivoting motion directed downwardly and laterally. The coupling hook abuts upwardly on the coupling carrier and in this position assumes its operating position. If now two rail vehicles come into contact for coupling, their respective coupling hooks because of their bent-back hook shape are pressed downwardly by the trap frame of the other vehicle until they are displaced upwardly within the trap frame by a spring attached to the rear end of the coupling hook.

Uncoupling of the vehicles by hand is rather complicated and is possible only with a device such as a screwdriver or the like. Accordingly, the manufacturer has provided a specially arranged uncoupling element which is positioned between the rails so that when the couplng hook travels over this uncoupling element, its downwardly curved rear end will move downwardly out of the trap frame of the adjacent coupling and the connection between the vehicles is thus released. Because the LGB cars respectively have a coupling hook at one end only while the other end is provided with a trap, care must always be taken that a vehicle end provided with a coupling hook and a vehicle end not having a coupling hook are coupled together.

Marklin coupling system for I gauge is considerably improved and is not encumbered by the limitations as described above. These automatic couplings are provided with claw-like hooks, one of which slides over the other when the rail vehicles come into contact with each other and fall into the operating position into the hook. Uncoupling is achieved by lifting one hook by means of a laterally extending handle or can be achieved automatically from below by a suitable uncoupling device placed between the rails.

All of the prior art coupling devices described above and other known coupling devices which have not been described, all have the disadvantage that because of their structure and mode of operation, it is not possible to obtain abutment in face-to-face relationship of opposing buffers on the rail vehicles. At the same time, there is an unnaturally large distance between coupled vehicles, and this has a disconcerting appearance to the eye, particularly for passenger cars which may have unconnected gangway fellows between the cars. The buffers on the rail vehicles have only a statistical value even when they have been designed to be resilient or yieldable. Because of the increasing demands by model railroaders for improved realism, manufacturers of model railway equipment are continuously attempting to make their equipment so as to more closely imitate actual railway practices.

It is therefore the principal object of the present invention to provide a novel and improved automatic coupling for model rail vehicles.

It is another object of the present invention to provide such automatic couplers which have significantly improved functional capabilities while at the same time imitate more closely actual railway practices.

It is another object of the present invention to provide such an automatic coupler which can be simply and reliably coupled or uncoupled without manual manipulation.

The objects of the present invention are achieved by providing a coupling plate on the end of a coupling carrier which projects beyond the end of the vehicle and a coupling hook also projects from the coupling carrier and can be resiliently brought into contact with the rear side of a like coupling plate of a second vehicle when the coupling plates come into contact.

According to one aspect of the present invention, an automatic coupling particularly for model railroad vehicles may comprise a coupling carrier disposed upon the central longitudinal axis of a rail vehicle and having an end thereof extending axially beyond the end of a rail vehicle. There is a coupling plate on the extending end of the coupling carrier. A resiliently mounted coupling hook protrudes axially from the coupling carrier beyond the coupling plate and has a portion thereon which extends into the outline of the coupling plate such that this portion of the coupling hook is engagable with the rear side of a like coupling plate of a second rail vehicle in a coupled position.

Other objects and advantages of the present invention will be apparent from the following description when taken in conjunction with the following drawings, which are exemplary, wherein.

Proceeding next to the drawings wherein like reference symbols indicate the same parts throughout the various views, a specific embodiment and modifications of the present invention will be described in detail.

Figure 1:
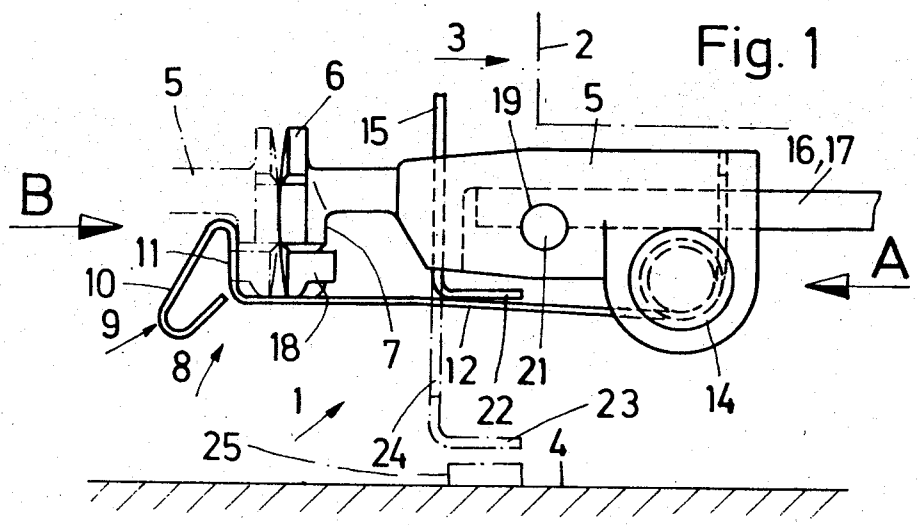
FIG. 1 is a side elevational view of the coupler according to the present invention.
Figure 4:
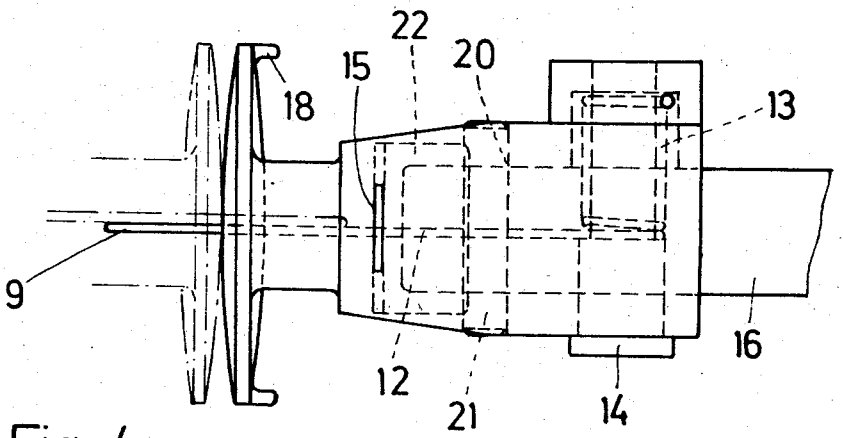
FIG. 4 is a top plan view of the coupler of FIG. 1.
Figure 2:
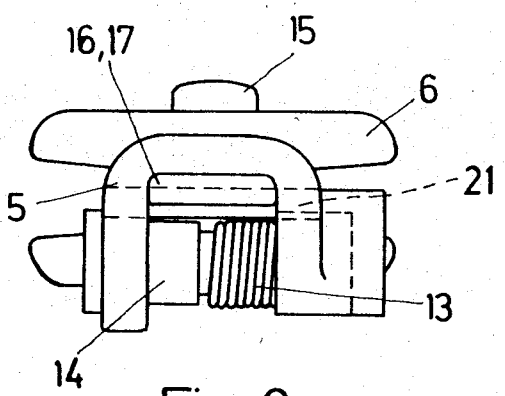
FIG. 2 is an end elevation view of the coupler viewed in the direction of the arrow A in FIG. 1.

In FIG. 1, there is indicated generally at 1 an automatic or contact coupler according to the present invention and mounted at one end of a body 2 of a railway car indicated generally at 3. In the conventional manner, the vehicle 3 is supported by wheels, not illustrated, to run upon rails 4. The coupler is positioned at least substantially in the central longitudinal axis of the vehicle 3 as may be seen in FIG. 4 and has a coupling carrier 5 which extends outwardly beyond the end of the railway car body 2. A coupling plate 6 is provided on the extending end of the coupling carrier 5 and the coupling plate 6 has a rear side 7 which is engagable by a coupling hook in a manner to be described.

A coupling hook indicated generally at 8 is formed from a spring steel wire and comprises a coupling yoke indicated generally at 9 which has a front side 10 inclined upwardly toward the vehicle and is connected at its upper end to a substantially perpendicular rear portion 11 which extends downwardly to connect to the end of a pull rod 12 which has at its other or inner end a torsion spring 13 consisting of a plurality of coils which surround a carrier bolt 14 and are nonrotatably supported upon this carrier bolt. The carrier bolt 14 is mounted transversely in the coupling carrier 5 and may be removed therefrom.

Figure 3:
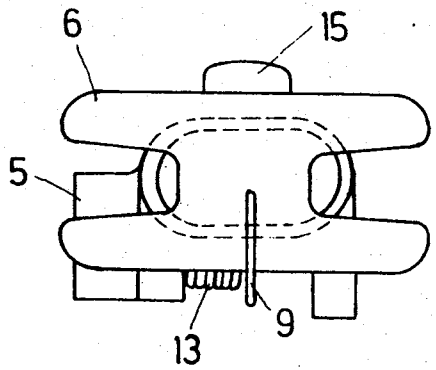
FIG. 3 is an end elevational view of the coupler viewed in the direction of the arrow B in FIG. 2.

The coupling hook 8 in this embodiment is integrally formed from a resilient steel wire which can thus be permanently shaped into the coupling yoke 9 and into the torsion spring 13. The coupling hook is thus anchored on the underside of the coupling carrier 5 and its free end is constructed similar to a hook-like coupling yoke. This relatively simple construction makes possible a frictionless mode of operation and enables the coupling hook to be readily and simply manufactured with a minimum of cost. The coupling hook is thus resiliently maintained against the underside of the coupling plate 6 as may be seen in FIGS. 1 and 3. The coupling plate 6 is preferably constructed as a resiliently or yieldingly mounted buffer, which is brought into face-to-face abutment at all times with a like coupling plate on a second rail vehicle when the vehicles are coupled.

The coupling plates remain in contact during operation of the train to avoid any gap between the coupled coupling plates of the two rail vehicles. This construction is closely based on the execution of various Swiss private railways and the rolling stock of the Swiss Federal Railways (SBB). This construction will give a realistic reproduction of a coupler.

The construction of the coupling hook as a torsion spring out of spring steel produces a very resilient structure which in the unloaded state enables the coupling hook to reliably assume its original or operating position as shown in FIG. 1.

Pull rod 12 could also be constructed as a leaf spring which is pivotably attached to the coupling carrier so as to be pivotable about a vertical axis. Springs may be provided to act laterally upon the leaf spring so as to maintain the leaf spring in a substantially longitudinal position so as to maintain its operating position. The pull rod in the form of a leaf spring could also be rigidly attached to the underside of the coupling carrier 5. The coupling hook 8 would then be shaped in the same manner as shown in FIG. 1 and would function in the same manner.

In order to prevent opposing coupling yokes 9 on vehicles to be coupled from striking each other, they are preferably positioned in a slightly offset position immediately adjacent the central longitudinal axis of the vehicle 3. This offset positioning can be seen in FIG. 4. According to the present invention, it would also be possible to provide only one end of the rail vehicle with a coupling hook. With this modification, care would then have to be taken during operation to couple together a respective vehicle end having a hook with an end of a second vehicle not having a hook. In all these constructions, the coupling hook 8 is readily detachable from the coupling carrier so as to be replaced, if necessary or desired.

Uncoupling of coupled vehicles is achieved by means of an uncoupling push member 15 which is slidably mounted for vertical movement in the coupling carrier 5 as shown and is positioned to be substantially perpendicular to the pull rod 12. The lower end of the push member 15 is bent at a right angle as shown, and may be provided with a plate 22 which is engagable with the upper side of the pull rod 12. It is thus apparent that a downward movement on the push member 15 will in turn push the pull rod 12 downwardly to disengage the coupling yoke 9 from behind a coupling plate. After uncoupling, coupling the coupling yoke 9 will move back to its original position because of its resilient construction and the underside of the coupling plate 6 will act as a stop for the pull rod 12.

In order to provide for automatic uncoupling of the rail vehicles 3 an electromagnet which is selectively operable is positioned between the rails in a manner as indicated at 25 in FIG. 1. When energized, the electromagnet 25 will pull downwardly the metal plate 22 which is positioned in a horizontal position at the lower end of the push member 15 and this will cause the push member 15 to move downwardly and, in turn, to move the pull rod 12 downwardly to uncouple the coupling hook in a manner as described previously. In this embodiment, the electromagnet 25 should be of a height which is less than the wheel axles of the railway vehicles. As an alternative, the push member 15 can be extended further downwardly and at its lower end provided with a plate 23 as shown in FIG. 1. The electromagnetic device 25 thus need only project a short distance above the height of the rail 4. Also, in this construction, a vertical slot 24 is provided in the push member to accommodate the pull rod 12.

The buffers or coupling plate 6 are provided along their sides in the longitudinal mid-axis thereof and at the height of the coupling yoke 6, with rearwardly protruding limiting cams 18 which limit the lateral movement of the pull rod 12. If the coupling plates 6 are located along the central longitudinal axis of the vehicle 3, then a rigid attachment of the coupler 1 to the vehicle 3 will be sufficient to maintain the lateral positioning of the coupling yoke 9. However, a more resilient coupling can be achieved if the coupler plates 6 are resiliently or yieldably attached to the vehicle 3. The presence of the limiting cam 18 have been found to be very effective in preventing any lateral sliding off of the coupling hook from behind the coupling plate when cars are in the coupled position. According to the present invention, railway vehicles 3 may also be provided with a pair of buffers or coupling plates spaced horizontally at one end of the vehicle. With a pair of buffers, it is then necessary that these buffers be resiliently compressible on the vehicles since the fixed distance between the vehicles as determined by the coupling hook 8 requires that the abutting buffers closer to the center of curvature of a curved track will be compressed while the outer abutting pair of buffers may separate from each other.

This resilient mounting of the buffers enables the coupling plates 6 or coupling carriers 5 to be resiliently mounted to the vehicle. This resilient mounting results in a smoother operation with particularly favorable results on larger gauges of model railways. The coupling carrier 5 of the coupler 1 is releasably attached to the chassis or frame of the vehicle 3 or to its bogie indicated at 16. Attachment to the bogie is referred for rail vehicles having four and more axles. A detachable mounting of the coupling carrier thus facilitates replacement and repair of the couplers since breakage of a coupling is to be expected in normal operation.

Detachable mounting of the coupler is provided by means of a flat support bracket 17 which has at its free end in the region of the coupling carrier 5, a transversely extending bore 19 which registers with a pair of opposed openings 20 provided in depending portions of the coupling carrier 5. A bolt 21 is then passed through the holes 20 and passage 19 and the bolt 21 is preferably constructed as a dowel pin which may be firmly seated but is yet easily removable to facilitate replacement of a coupler. The support bracket 17 may be attached either to the bogie 16 of a vehicle or directly to the frame of the vehicle.

The resilient structure of the coupling yoke 9 enables the coupling yoke to function as an overload protection for coupled vehicles. It may occur that a locomotive may be overloaded because of being coupled to an excessive number of cars. The coupling yoke 9 can be so constructed as to correspond to the power capability of the locomotive and so dimensioned that the coupling yoke will open, by deformation, when the coupled load is excessive.

It is apparent that the inclined portion 10 of the coupling yoke 9 will cause the coupling yoke to be cammed downwardly upon contact with a coupling plate of a second vehicle as the second vehicle and first vehicle approach each other into abutting relationship. Upon contact of the opposed coupling plate 6, the coupling yoke will snap into coupled position behind the second coupling plate in the manner as shown in FIG. 1.

Uncoupling of the vehicles is achieved by manually depressing the push member 15 downwardly to disengage the coupling yoke 9 from behind the second coupler plate. As an alternative, the cars may be uncoupled automatically by the presence of an electromagnet device between the rails of the road bed acting upon metal plates 22 or 23 attached to the push member 15.

The coupler, according to the present invention, is simple in construction and operation but is reliable in maintaining the coupled relationship of railway vehicles. Because of their relatively low cost, these couplers are expendable and may be readily discarded should they be damaged in the course of operation of the railway.

It will be understood that this invention is susceptible to modifications to adapt it to different usages and conditions and, accordingly, it is desired to comprehend such modifications within this invention as may fall within the scope of the appended claims.

What is claimed is:

1. An automatic coupling particularly for model rail vehicles comprising a coupling carrier disposed along substantially the central longitudinal axis of a rail vehicle and having an end extending axially outwardly of an end of the rail vehicle, a coupling plate on the axially extending end of the coupling carrier, and a coupling hook resiliently mounted on said coupling carrier and having an end protruding axially beyond said coupling plate, said coupling hook having a portion on said protruding end extending into the outline of said coupling plate, said coupling hook portion resiliently engages the rear side of a like coupling plate of a second rail vehicle in a coupled position in such a manner that said coupling plate is in face-to-face abutment with said like coupling plate at all times to avoid any gap between coupled coupling plates of two rail vehicles.

2. An automatic coupling as claimed in claim 1 wherein said coupling hook comprises a pull rod resiliently mounted on the underside of said coupling carrier, and said portion on said protruding end comprising a coupling yoke, said pull rod has a second end and a coil torsion spring on said second end, a carrier bolt disposed horizontally and transverse to said longitudinal axis in said coupling carrier, the coil of said torsion spring non-rotatably supported upon said carrier bolt passing there-through, said coil torsion spring having a first leg comprising said pull rod and a second leg engaging a stationary portion of said coupling carrier.

3. An automatic coupling as claimed in claim 2 wherein said coupling yoke comprises an inclined forward portion and a substantially perpendicular rearward portion connected to said pull rod.

4. An automatic coupling as claimed in claim 2 wherein said pull rod comprises a leaf spring.

5. An automatic coupling as claimed in claim 2 and further comprising a push member slidably mounted on said coupling carrier and engageable with said pull rod substantially perpendicular thereto in a downward direction to uncouple said coupling hook.

6. An automatic coupling as claimed in claim 5 and further comprising a substantially horizontal metal plate on said push member, and a selectively operable electromagnet disposed between rails of a road bed to act upon said metal plate when energized to uncouple said coupling hook.

7. An automatic coupling as claimed in claim 1 and further comprising means on said coupling plate protruding rearwardly and substantially at the level of said coupling hook for limiting the lateral movement of said pull rod and coupling hook.

8. An automatic coupling as claimed in claim 1 wherein said coupling carrier is detachably fastened to a portion of the rail vehicle.

9. An automatic coupling as claimed in claim 1 wherein said coupling carrier is detachably fastened to a bogie of the rail vehicle.

10. An automatic coupling as claimed in claim 1 and further comprising a flat bracket member adapted to be fastened to one of a frame or a bogie on said rail vehicle, there being a transversely extending bore through said flat bracket member co-registering with a pair of opposed holes in said coupling carrier and a bolt through said holes and bore.

* * * * *